US006206077B1

(12) United States Patent
Stanfill

(10) Patent No.: US 6,206,077 B1
(45) Date of Patent: Mar. 27, 2001

(54) METHOD AND APPARATUS FOR MAKING IMAGE LADENED LOUVERED BLINDS

(76) Inventor: Arthur A. Stanfill, 329 Garnett, Suite 1, Wichita, KS (US) 67206

( * ) Notice: Subject to any disclaimer, the term of this patent is extended or adjusted under 35 U.S.C. 154(b) by 0 days.

(21) Appl. No.: 09/412,746

(22) Filed: Oct. 5, 1999

Related U.S. Application Data

(63) Continuation-in-part of application No. 09/115,264, filed on Jul. 14, 1998, now abandoned.
(60) Provisional application No. 60/056,404, filed on Aug. 26, 1997.

(51) Int. Cl.[7] ..... E06B 9/26
(52) U.S. Cl. ..... 160/174 V; 160/236; 160/405
(58) Field of Search ..... 160/168.1 R, 168.1 V, 160/172 V, 173 R, 173 V, 174 V, 176.1 V, 177 V, 178.1 V, 178.2 R, 236, 405, 900, 107; 49/92.1

(56) References Cited

U.S. PATENT DOCUMENTS

| | | | | |
|---|---|---|---|---|
| 4,049,038 | | 9/1977 | Hyman et al. . | |
| 4,195,680 | | 4/1980 | Hyman et al. . | |
| 4,842,036 | | 6/1989 | Goodman . | |
| 4,884,352 | * | 12/1989 | Lipscomb | 40/611 |
| 4,911,220 | | 3/1990 | Hiller . | |
| 5,029,413 | * | 7/1991 | Jovanovic | 160/236 X |
| 5,101,876 | | 4/1992 | Zak . | |
| 5,105,870 | | 4/1992 | Merjane . | |
| 5,263,529 | * | 11/1993 | Landis | 160/236 |
| 5,447,758 | * | 9/1995 | Pelletier | 427/511 |
| 5,655,589 | * | 8/1997 | Vartanian | 160/236 X |
| 6,042,912 | * | 3/2000 | Simoni | 428/38 |

* cited by examiner

*Primary Examiner*—David M. Purol
(74) *Attorney, Agent, or Firm*—Richard C. Litman

(57) ABSTRACT

A method and apparatus for making image ladened louvers having a louver bracket support system from which a plurality of louvers depend, each louver having a substantially flat elongated panels with an outer face, the outer faces of the panels forming a copy surface on which a composite image is displayed, each outer face displaying a sub-part of the composite image such that the conglomeration of the plurality of louvers forms a continuous whole of the image, and a method of making the same comprising the steps of (1) selecting a size of the louvers to fit a predetermined sign location, (2) selecting a template corresponding in size to the selected size of the louvers, the template for temporarily securing the louvers, (3) securing the louvers within the template, (4) calculating the magnitude of a transition loss, the transition loss being the portion of the composite image in an unprintable region between the louvers, (5) determining the sub-parts of the composite image based on a size of the copy surface, the width of the louvers, and the magnitude of the transition loss, (6) selecting a method of adhering the sub-parts of the composite image to the copy surface, (7) adhering the image to a cleaned copy surface such that corresponding ones of the plurality of outer faces each display a sub-part of the composite image.

11 Claims, 7 Drawing Sheets

METHOD AND APPARATUS FOR MAKING IMAGE LADENED LOUVERED BLINDS

CROSS-REFERENCE TO RELATED APPLICATION

This application claims the benefit of U.S. Provisional Patent Application Ser. No. 60/056,404, filed Aug. 26, 1997 and is a continuation-in-part of U.S. patent application Ser. No. 09/115,264 filed on Jul. 14, 1998 now abandoned.

BACKGROUND OF THE INVENTION

1. Field of the Invention

The present invention relates generally to louvered blinds. More specifically, the invention is a method and apparatus for making image ladened louvers as an advertisement medium or as window coverings with a discernible pattern of indicia.

2. Description of Related Art

The use of louvered vertical or horizontal blinds as a functional covering for a window or door or the like is well known. Often a need exists, or it is desirable, to decorate louvered vertical blinds, as evidenced by the art described below.

For example, U.S. Pat. No. 4,049,038, issued to David L. Hyman et al. on Sep. 20, 1977 discusses this need regarding a vertical blind having flanged channels extending along the edges of each louver for insertion of a panel having a pattern to match a room decor. U.S. Pat. No. 5,101,876, issued to Helga M. Zak on Apr. 7, 1992 describes vertical blinds wherein each louver is surrounded by a sheath of an upholstery or wallpaper matched piece of fabric.

The coloring of vertical blinds is also often important. Thus, there is a need for a vertical blind having a carefully matched color scheme. This need is discussed in U.S. Pat. No. 4,195,680, issued to David L. Hyman et al., on Apr. 1, 1980, for the use of interchangeable transparent colorized sheets with the blinds of Hyman '038, described above.

When a pattern is applied to a vertical blind, it is unstable and easily damaged. Thus, there is a need for a protective laminate that secures and protects a pattern applied to a vertical blind. This problem and need are discussed in U.S. Pat. No. 4,842,036, issued to Barry I. Goodman on Jun. 27, 1989 for a laminate for vertical blinds.

The aforementioned patents disclose inventions relating to general patterns and color schemes, such as typify wallpaper and upholstery, for use with vertical blinds. However, there is a need for vertical blinds which include a composite image which convey a message, particularly for commercial uses such as advertising. U.S. Pat. No. 4,911,220, issued to Kevin L. Hiller on Mar. 27, 1990 discusses this need and other problems associated with some of the previously recited patents in a patent for a removable tubular covering for the louvers in vertical blinds.

Though the need is recognized, none of the above inventions and patents describe the application of a single composite graphical image to a vertical blind. Likewise, none of the above inventions and patents, taken either singly or in combination, is seen to describe the instant invention as claimed.

SUMMARY OF THE INVENTION

The present invention is a method and apparatus for making image ladened louvers comprising a louver bracket support system from which a plurality of louvers, having substantially flat elongated panels with outer faces. The outer faces of the panels form a copy surface on which a composite image is adhered to and displayed, each outer face displaying a sub-part of the composite image such that the conglomeration of the plurality of louvers forms a continuous whole of the image with minimized transition loss between sub-parts of the composite image. Additionally, a method is included wherein a louver assembly is produced via the method the steps of (1) selecting a size of the louvers to fit a predetermined composite image location, (2) selecting a template corresponding in size to the selected size of the louvers, the template for temporarily securing the louvers, (3) securing the louvers within the template via a bracket assembly, (4) calculating the magnitude of a transition loss, the transition loss being the portion of the composite image in an unprintable region between the louvers, (5) determining the sub-parts of the composite image based on a size of the copy surface, the width of the louvers, and the magnitude of the transition loss, (6) selecting a method of adhering the sub-parts of the composite image to the copy surface, (7) adhering the image to the copy surface such that corresponding ones of the plurality of outer faces each display a sub-part of the composite image, and (8) smoothing the adhered composite image to reduce air-pockets and the like therbetween.

Accordingly, it is a principal object of the invention to provide a method and apparatus for making an image ladened louver assembly for displaying at least one composite graphical image.

It is another object of the invention to provide a bracketing technique which duplicates a pre-selected composite image onto a plurality of louvers with minimized transition loss.

It is a further object of the invention to reduce air pockets between the copy surface and an applied composite image and its sub-parts which produces image distortion and image degradation over time.

It is an object of the invention to provide improved elements and arrangements thereof in a method and apparatus for making imaged ladened louvers which is inexpensive, dependable and fully effective in accomplishing its intended purposes.

These and other objects of the present invention will become readily apparent upon further review of the following specification and drawings.

DETAILED DESCRIPTION OF THE PREFERRED EMBODIMENT

The present invention is directed to a method and apparatus for making image ladened louvers. The preferred embodiments of the present invention are depicted in FIGS. 1–6B, and are generally referenced by numeral 10.

Figure 1:
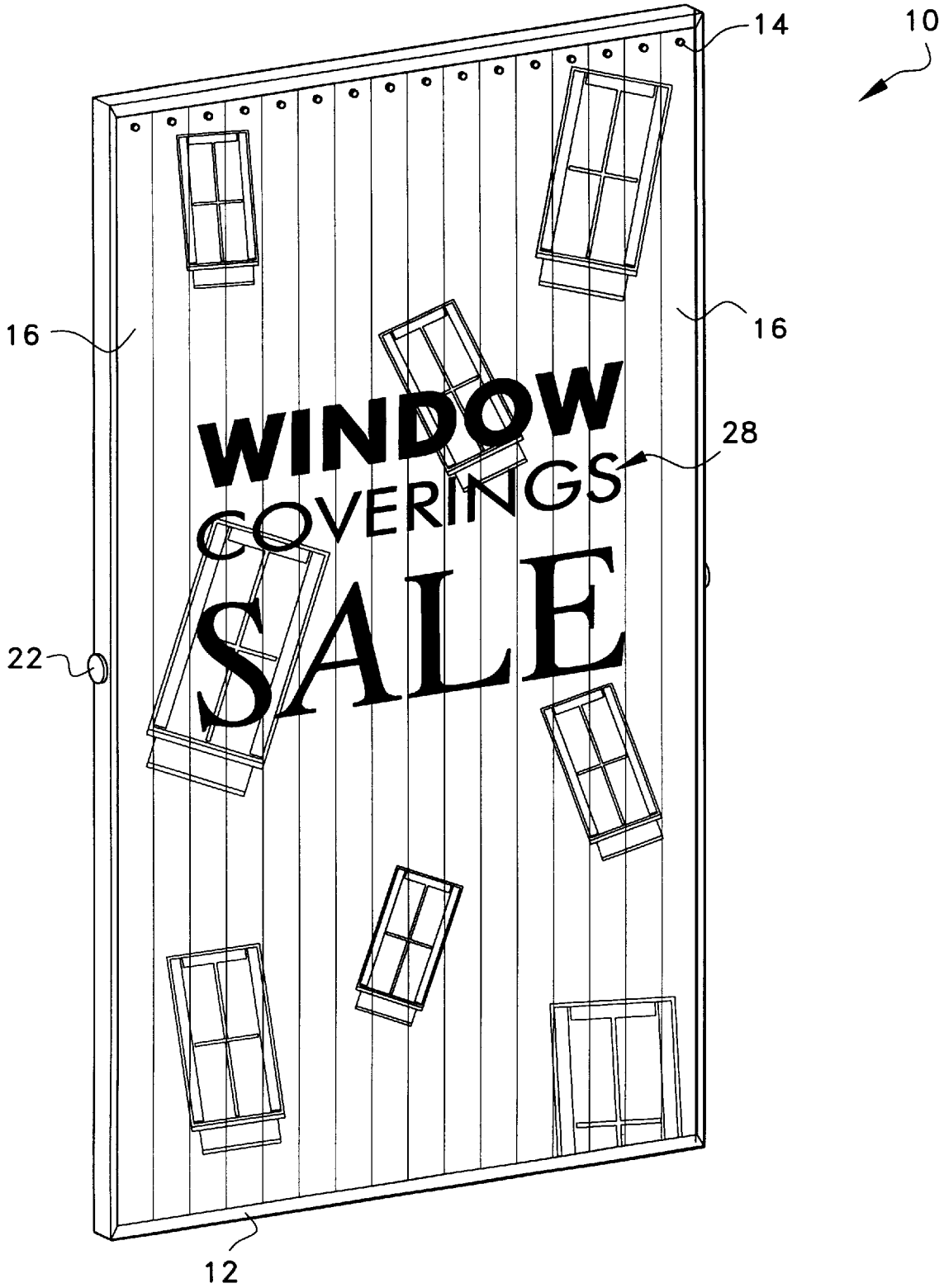
FIG. 1 is an environmental perspective view of an image ladened louver assembly according to the present invention.

FIG. 1 shows an image ladened louver assembly 10 in a store front window 12. Any number of conventional louver activating mechanisms can be used to operatively close and open louvers or panels 16 to respectively show images thereon. Bracket support means or rail 14 is uniformly disposed and spaced at the top of the window 12 on the interior of the window 12. A plurality of associated elongated louvers 16 hang vertically down from the support rail 14 covering the inside of the window 12. A substantially flat elongated panel of such makes up the body of each of the louvers 16. The louvers 16 are rotatably attached in a conventional manner to the support rail 14 and depend vertically therefrom.

Figure 2:
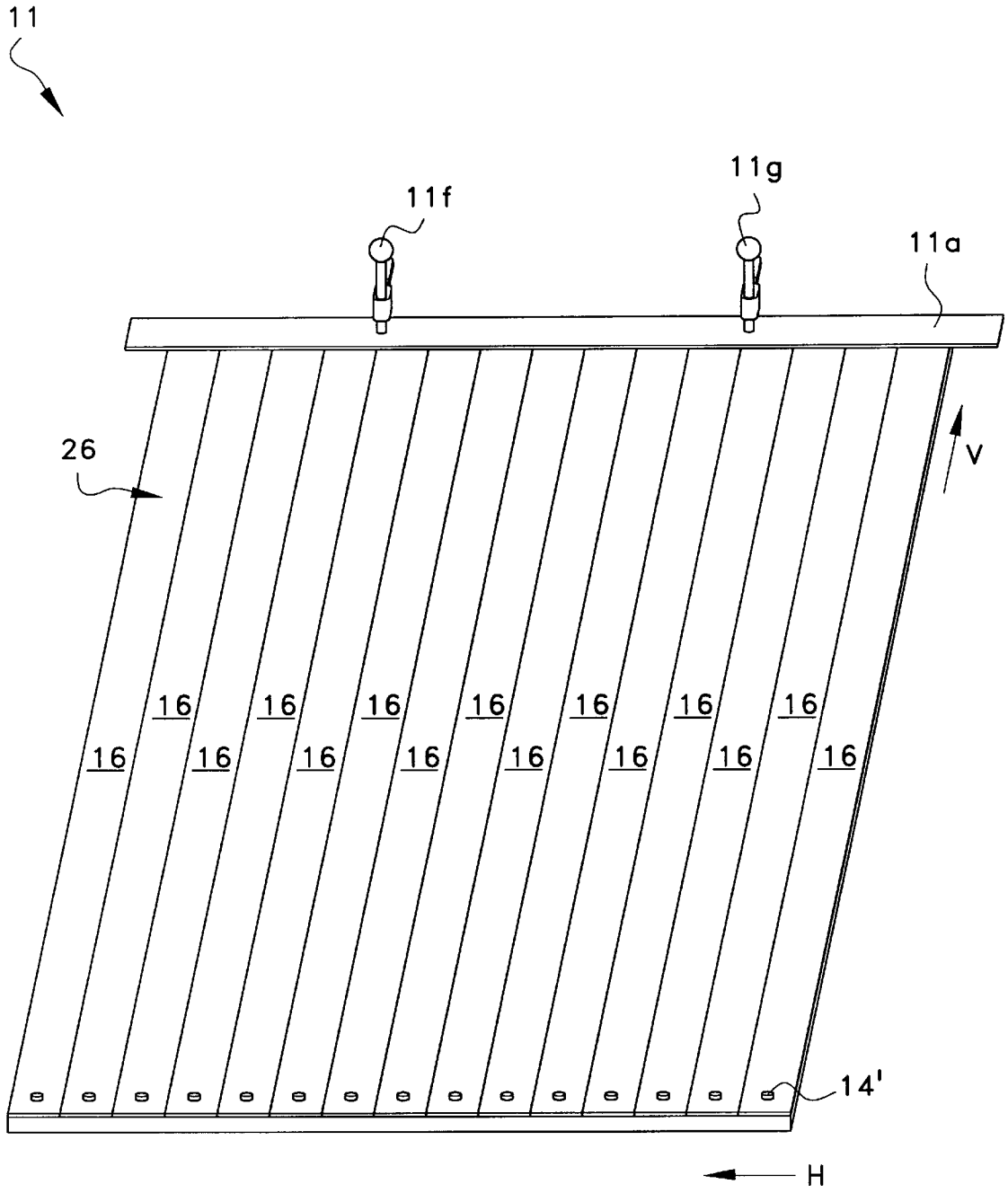
FIG. 2 is a perspective view of the bracketing assembly for making an image ladened louver assembly according to the invention.
Figure 3:
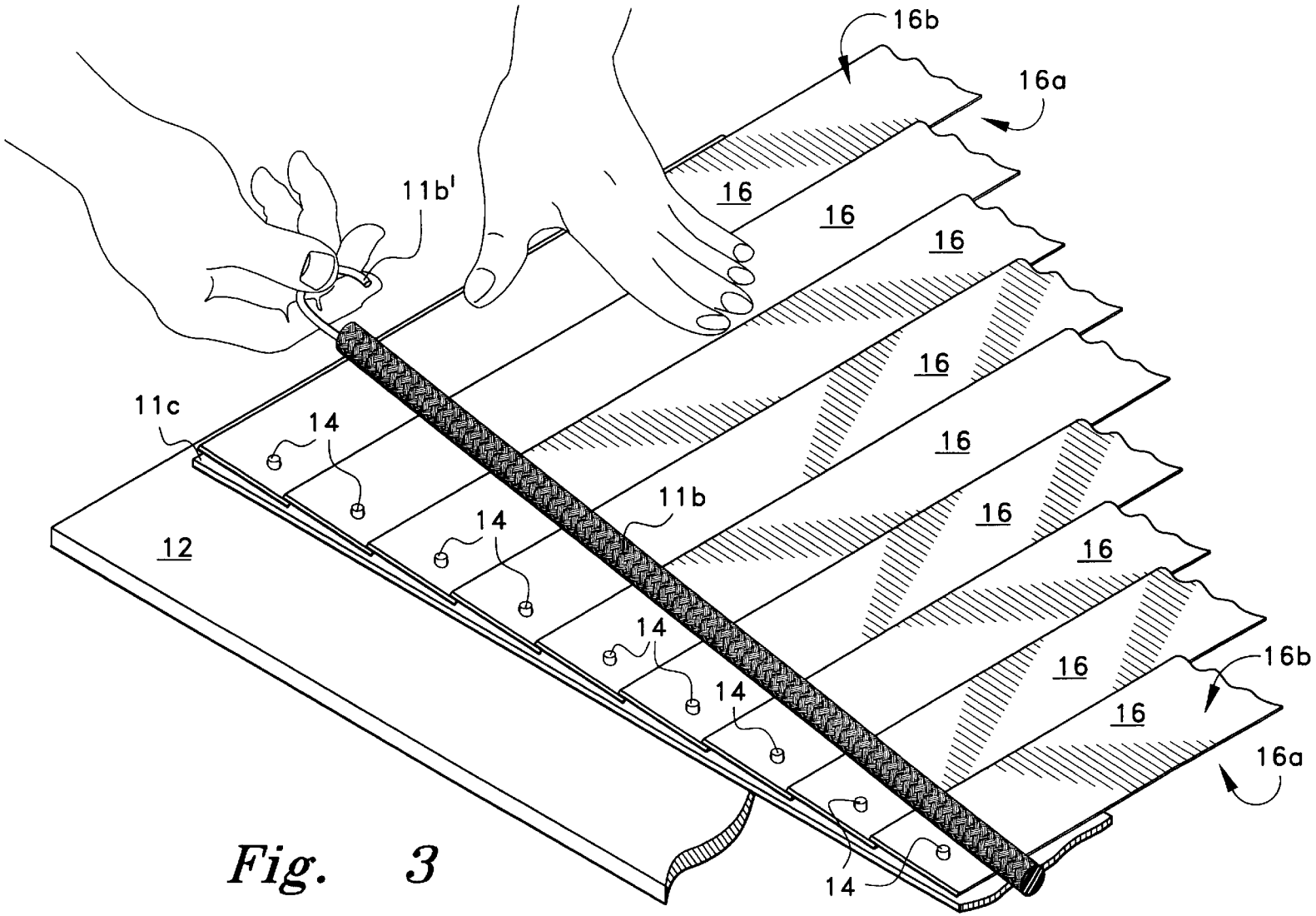
FIG. 3 is a perspective view of the bracket assembly, illustrating the louver mounting strap and spacer blockers according to the invention.
Figure 4:
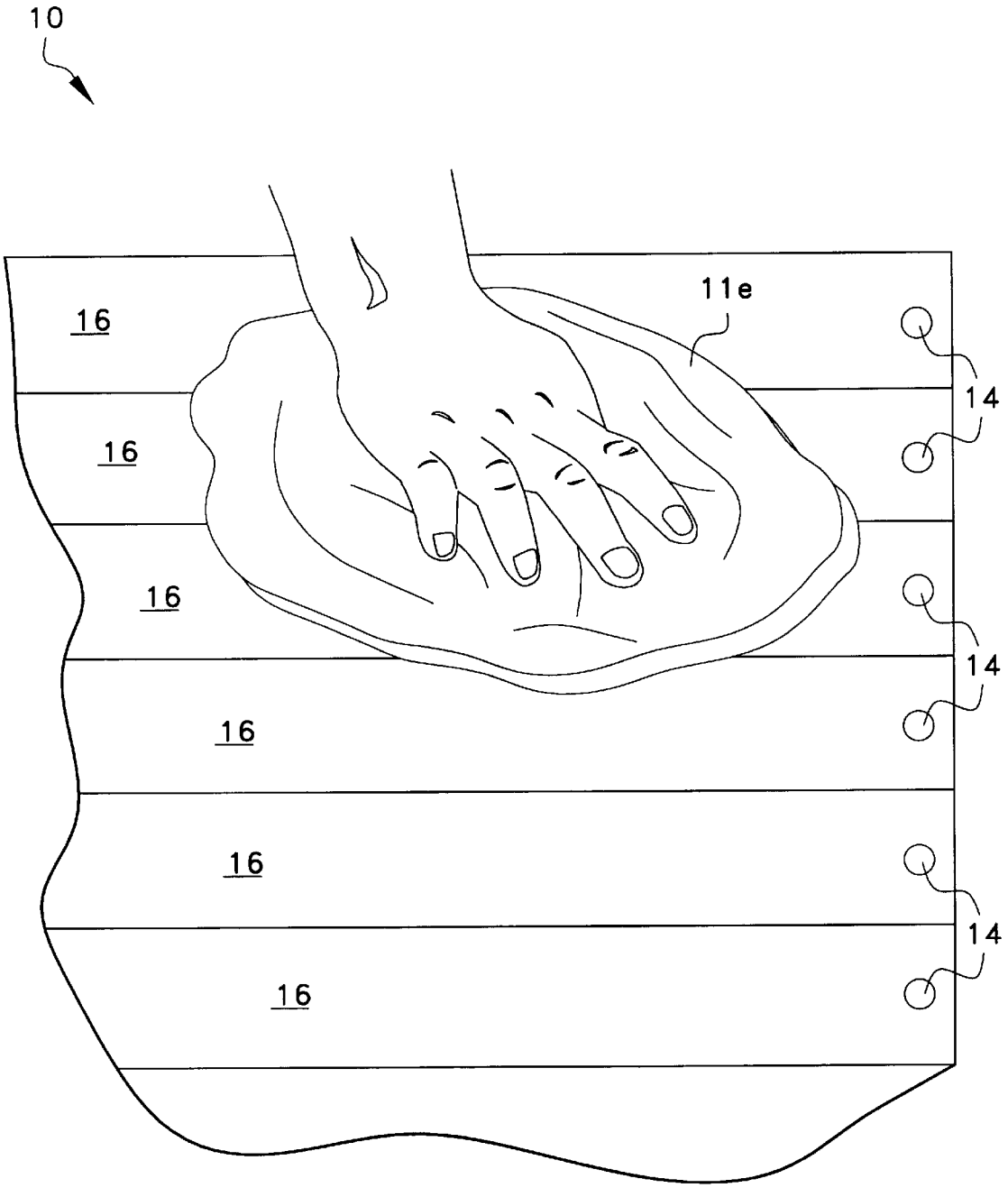
FIG. 4 is a perspective view of the louver copy surface according to the invention, illustrating the application of cleaner solution.

As best seen in FIGS. 2–3, a louver support bracket assembly 11 is shown wherein the bracket assembly 11 comprises a template 11*a,* louver strapping means 11*b* having at least one attachment end 11*b*' for attachment to a louver spacer blocker 11*c* and an associated plurality of louver support means or rails 14. The plurality of rails 14 wherein at least one of said plurality retains at least one louver 16 as a fixed louver attachment. The plurality of associated elongated louvers 16 each comprising substantially flat elongated panels having an inner face 16*a* and an outer face 16*b*. Each of the elongated louvers 16 are preferably uninterrupted, substantially flat copy surfaces. To ensure proper adhesion the copy surface (louvers without and image) is washed or cleansed with a cloth 11*e* substantially saturated with an evaporative solution such as ethyl alcohol or the like. This layer can also include the application of a protective layer, such as a laminate layer of plastic to prevent material contamination from air carrying particles such as dust, mites etc.

FIG. 2, also illustrates the use a first 11*f* and second 11*g* bracket alignment means for uniformly adjusting each of the plurality of louvers in a vertical V and horizontal H fashion. Each respective alignment means is a screw mechanism which allows for adjustment along the face of the template 11*a* for adjusting the copy surface with minimum gaps between respective louvers 16.

Figure 5:
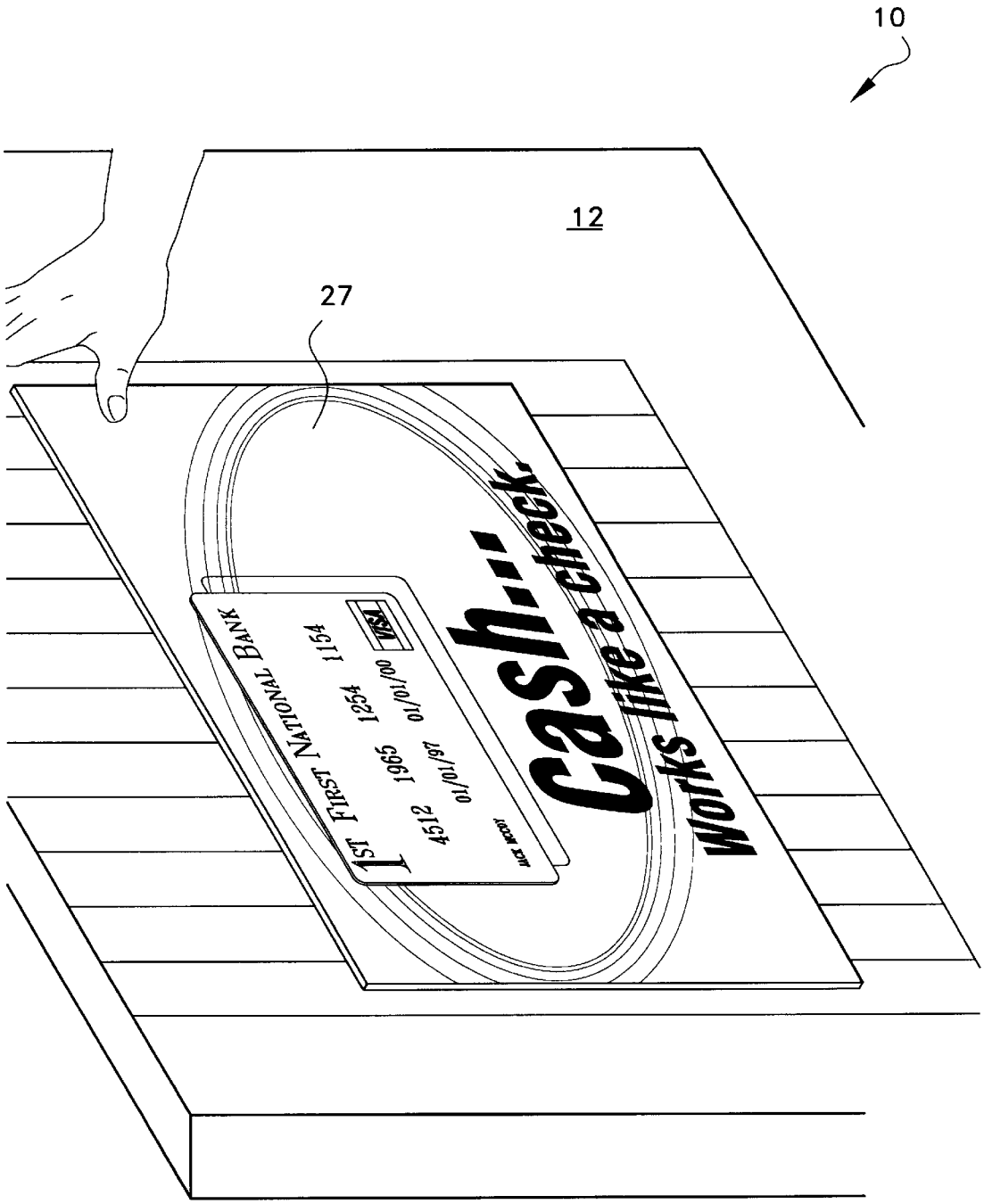
FIG. 5 is perspective view of an image ladened louver assembly according to a second embodiment.
Figure 6A:
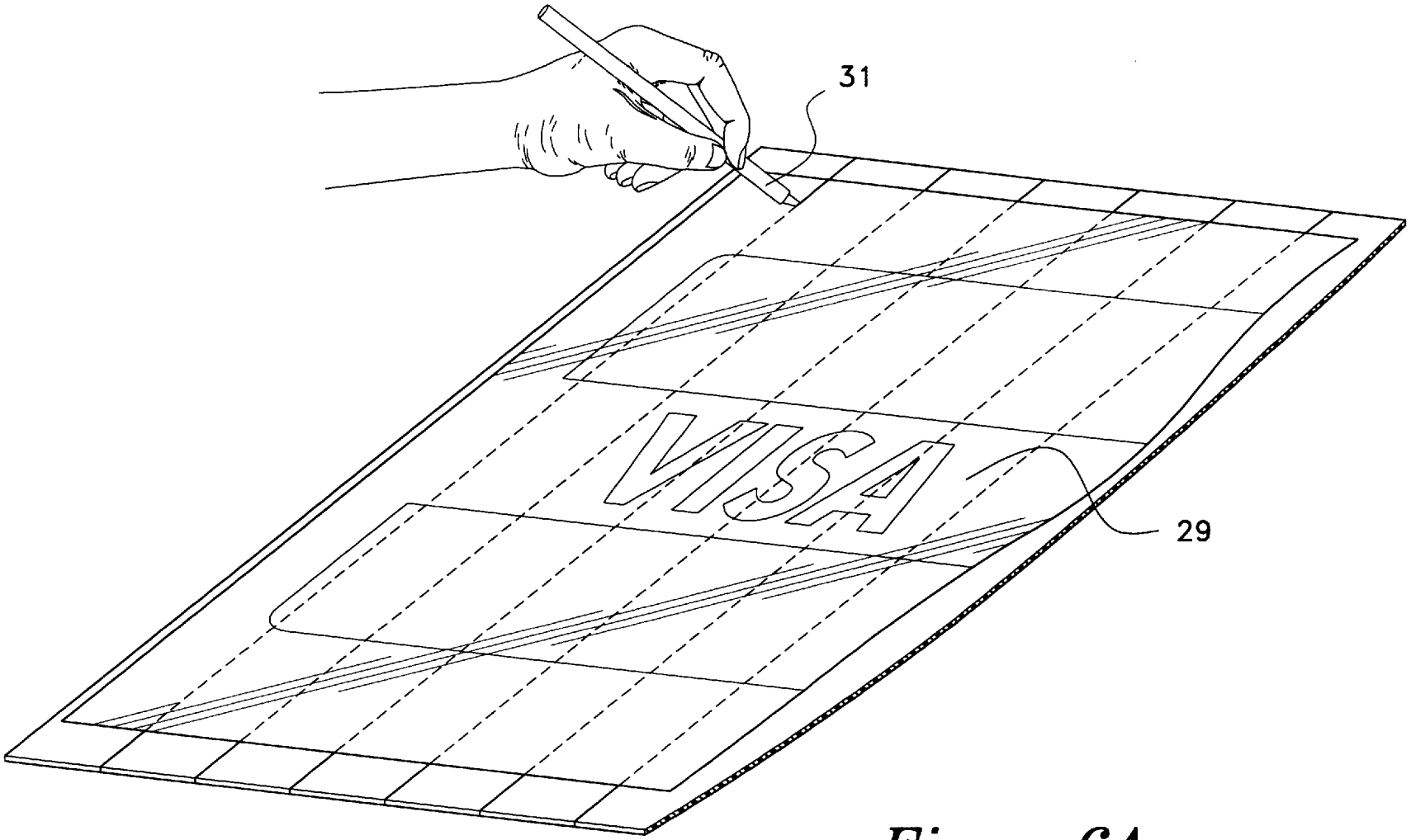
FIG. 6A is a perspective view of the louver assembly, illustrating sub-parts of a composite image.
Figure 6B:
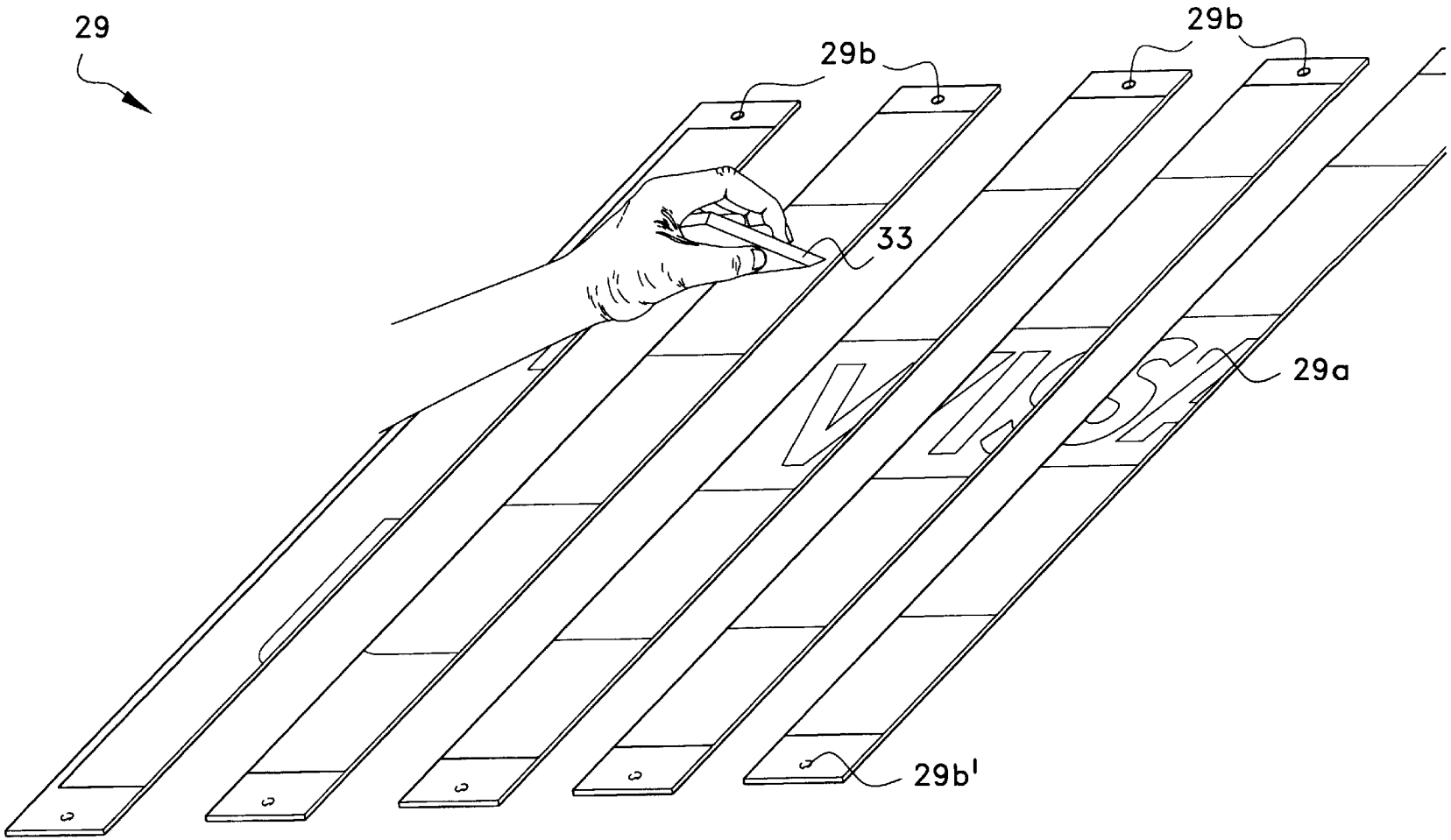
FIG. 6B is a perspective view of the louver assembly according to the invention, illustrating smoothing of the sub-parts of FIG. 6A.

Similar rails 14' are disposed on another end of the bracket assembly 11 prior to image application and subsequent installation of each louver 16 in a respective window, door, etc. The laminate layer can include at least one composite image 26 disposed thereon. FIGS. 5, 6A, and 6B disclose other embodiments 27 and 29 of image ladened louvers. The particular composite image is preferably disposed on the copy surface as a preprinted, die cut, adhesive decal at least. As diagrammatically illustrated in FIG. 6A and 6B each image ladened louver is cut via a cutting means or "zacto" knife 31 into sub-parts 29*a*. A smoothing means or "squeegee" 33 such as a ceramic bar or other smooth surface material having a pitched surface area for smoothing out accumulated air pockets or superfluous adhesive solution therefrom. The apparatus according to claim 1, wherein the louvers are made according to a predetermined length and width An operator activates via a rotation motion a control wand 22 which twists the control wand 22, the louvers 16 rotate in the support rail 14. When the louvers 16 are in a fully closed position an inner face 16*a* on each panel or louver 16 faces away from the window 12 and an outer face 16*b* on each panel 16 faces toward the window 12. Thus, in the fully closed position, the plurality of associated flat elongate panels 16 form a substantially flat, substantially uninterrupted copy surface 26 facing outward from the window 12 as shown each respective figure.

A composite image 28 is visible on the copy surface 26. In FIG. 1, the composite image 28 comprises indicia such as "WINDOW COVERINGS SALE", VISA™, etc. in large or lower case block letters. The composite image 28 is significantly larger than any one of the plurality of outer faces 16*b* such that no one outer face 16*b* can possibly contain the entire image 28. Thus, it is necessary to break the composite image 28 into a plurality of sub-parts as shown as 29*a* in a particular embodiment in FIG. 6B. One sub-part 29*a* of the composite image 29 is visible on each one outer face 16. By combining the sub-parts 29 together in a substantially continuous whole across the outer faces 16*b* of the associated louvers 16, the composite image 29 (including 28) is visible as if it were printed on a single uninterrupted plane. Apertures 29*b* are also disposed within each respective louver at a top portion and optionally 29*b*' at the bottom of each respective louver for attachment with the rails 14.

The steps of the process to make the above described louver assembly will now be described in detail. First, a size of the louvers 16 must be selected. The selection of the size of the louvers 16 depends primarily on the size of a predetermined window 12, door, or other opening that the vertical sign blind 10 is intended to cover, and secondarily on whether the image ladened louver 10 will cover the predetermined window 12 from the outside or from the inside. References herein to the window 12 should not be construed as limited to a window, but should be understood to include an application of the image ladened louver 10 to a door or other opening as well.

When the image ladened louvers 10 cover the window 12 from the outside, it is recommended that the dimensions of the area formed by the outer faces 16*b* when the vertical sign blinds 10 are in the fully closed position exceed the dimensions of the window 12 by at least three inches in length and at least three inches in height. In order to achieve an optimal level of privacy and light blockage, it is recommended that the dimensions of the area formed by the outer faces 16*b* exceed the dimensions of the window 12 by eight inches in height. Otherwise the dimensions of the panels 16 are considered acceptably sized as long as the height and length of the panels 1 meets or exceeds the corresponding dimension of the window 12. Similar adjustments are made for stacking height and stacking vane widths as is known in the art when the covered opening is a patio door rather than a window 12.

By experience, the smallest size panel 16 observed in a blind 10 is one inch wide and twelve inches high. In this smallest application, the dimensions of the area formed by the outer faces 16*b* when the blinds 10 are in the fully closed position is twelve inches by fourteen inches. Likewise, the largest size panel or louver 16 observed in a blind 10 has been three and a half inches wide and twelve feet high. The dimensions of the area formed by the outer faces 16*b* when this largest vertical sign blind 10 is in the fully closed position is twelve feet by fifteen feet.

The next step in the process to make the vertical sign blind 10 is the selection of a template. The selected template is shaped to secure the panels 16 around the edges of the panels 16 with the outer faces 16*b* facing up. Thus, different sized templates correspond to different sized louvers 16. Once the template is selected, the louvers 16 are placed and secured in the template thus stabilizing the outer faces 16*b* of the panels 16.

Two calculations must be made prior to the application of the sub-parts 30 of the composite image 28 to the outer faces 16*b*. First, the dimensions of the copy surface 26 must be determined. If the blind 10 is installed to the exterior of the window 12, the copy surface 26 is equal to the entire surface formed by the outer faces 16*b* of the panels 16 in the fully closed position. When the blind 10 is installed to the interior of the window 12, in order to make the entire copy surface 26 visible from the exterior of the window 12, the copy surface 26 must be smaller in area than the entire surface area formed by the outer faces 16*b* when the louvers 16 are in the fully closed position. Moreover, the deeper the sill of window 12, and hence the farther removed the copy surface 26 is from the window pane, the greater the difference must be between the area of copy surface 26 and the area of the surface formed by the outer faces 16*b* when the louvers 16 are in the fully closed position for an observer positioned an angle to the edge of the window pane to be able to see the entire copy surface. Otherwise, to see the entire copy surface, it would be necessary to stand directly in front of the window 12.

The second calculation that must be made prior to the application of the sub-parts 30 of the composite image 28 to the outer faces 16*b* concerns a concept known as a transition loss. The transition loss is caused by small gaps between the panels 16. Even in the fully closed position, the edges of the panels 16 do not sit completely flush with each other. If the edges of the panels 16 did sit completely flush in the fully closed position, then the louvers 16 would not be able to freely rotate out of or back into the fully closed position. However, the composite image 28 cannot be printed in the region of the gaps 32. Thus, by designing the panels 16 with small gaps 32 between them so that the louvers 16 rotate freely, the continuity of the composite image 28 is interrupted.

Because the gaps 32 exist between the panels 16, the copy surface 26 is not completely continuous. Thus, the composite image 28 must be modified to compensate for the loss of a small portion of the image 28 that would appear in the unprintable region of the gaps 32. It has been determined that the appearance of the composite image 28 is not compromised when the magnitude of the transition loss is ascertained and compensated for prior to the application of the sub-parts 30 to the outer faces 16*b*. Again using the example of the standard vertical blind 10 pictured, it has been determined that the transition loss for the smallest panel 16, the one inch wide panels 16 mentioned above, is one thirty-second of an inch. Similarly, it has been determined that the transition loss for the largest panel 16, the three and a half inch wide panels 16 mentioned above, is one-eighth of an inch. It should be apparent that the transition loss for other sizes and styles of blinds is determined through the use of linear extrapolation from the numbers supplied above.

Once the transition loss has been calculated, the next step is to determine the sub-parts 30 of the composite image 28. To determine the sub-parts, it is recommended that first, the composite image 28 be scanned into a computer and electronically reproduced as a graphics file in a graphics program. Then, the dimensions of the copy surface 26 are entered and the composite image 28 is conformed to those dimensions. Next, the width of the panels 16 and the transition loss is entered. Finally, the graphics program eliminates a sliver portion of the composite image 28 that would appear in unprintable the area of the transition loss and assigns the remaining portions of the composite image 28 to each sub-part 30 for electronic digital reproduction. Lines in the composite image 28 are extrapolated across the area of the transition loss by the graphics program to maintain an even appearance of the composite image 28 on the copy surface 26.

Once the sub-part 30 corresponding to each one outer face 16*b* has been determined, a method of adhering the sub-parts 30 to the outer faces 16*b* must be selected from those known in the art such as printing on a die cut adhesive decal for sticking on the outer faces 16*b*, printing on adhesive stickers for sticking on the outer faces 16*b*, and printing directly on the outer faces 16*b*.

Furthermore, a method of printing the sub-parts 30 must also be selected from those known in the art such as thermal transfer vinyl graphics, silk screening, ink-jet graphics, and electrostatic graphics. Due to variations in quality and cost, it is recommended that a different type of print be selected depending on the number of copies of the composite image 28 to be reproduced. When the number of copies of the composite image 28 to be reproduced is a single digit, the recommended method of printing is electrostatic graphics. When the number of copies to be reproduced is a double digit, ink-jet graphics is the recommended method of printing. And when the number of copies of the composite image 28 to be reproduced is at least one hundred, the recommended method of printing the sub-parts 30 is thermal transfer graphics.

When the method of adhering the sub-parts 30 to the outer faces 16*b* is to print the sub-parts 30 directly on the outer faces 16*b*, then the process is complete once the sub-parts 30 are printed. When the method of adhering the sub-parts 30 to the outer faces involves adhesive decals or stickers, then the process is completed by adhering the decals or stickers to the outer faces 16*b*.

It is recognized in the art that a many problems are solved by the application of a transparent laminate on the copy surface 26. Thus, as a final step in the preferred embodiment, a transparent laminate is applied to stabilize and protect the panels 16.

It should be recognized that in some cases a need will exist to change the composite image 28 visible from the exterior of a window. For example, when the vertical sign blind 10 is used by a commercial business, the business owner may want to seasonally display a specific holiday promotion in the composite image 28 once a year. In this situation, a second set of louvers 16 is supplied with the ones of the panels 16 displaying the sub-parts 30 of the second composite image 28. When the time arrives to change the composite image 28 visible from outside the window 12, the first set of louvers 16 is removed from the support rail 14 and the second set of louvers 16 is secured to the support rail 14. This process of changing one set of louvers 16 for another set of louvers 16 takes no more than five or ten minutes. Thus, it is equally, if not more, convenient than the other apparatuses and methods known to achieve the same function of changing an image displayed by a vertical blind 10.

It is to be understood that the present invention is not limited to the embodiment described above. For example, though the embodiment described above is only printed on the outer faces, it should be apparent that the invention is capable of application to the inner faces as well, thus adhering composite images to the same set of louvers on opposite faces, respectively. Thus, it is to be understood that the present invention encompasses any and all embodiments within the scope of the following claims.

I claim:

1. An apparatus for composing an image ladened louver assembly comprising:

a. a louver support bracket assembly, wherein said bracket assembly comprises a template, louver strapping means and a plurality of louver support means, said plurality wherein at least one of said plurality retains at least one louver as a fixed louver attachment;

b. a plurality of associated elongated louvers each comprising a substantially flat elongate panels having an inner face and an outer face, the elongate panel forming the body of the elongate louver, and wherein said inner and outer face being a substantially uninterrupted, substantially flat, copy surface, the copy surface including at least one protective laminate layer.

2. The apparatus according to claim 1, further comprising a first and second bracket alignment means for uniformly adjusting each of said plurality of louvers in a vertical and horizontal fashion.

3. The apparatus according to claim 1 wherein the protective laminate layer is at least one composite image disposed thereon.

4. The apparatus according to claim 3, wherein the disposed composite image includes sub-parts of the copy surface being made of preprinted, die cut, adhesive decals.

5. The apparatus according to claim 1, wherein the louvers are made according to a predetermined length and width.

6. A method of making an image ladened louver assembly, comprising a plurality of associated elongated louvers having a substantially flat elongate panel with an inner face and an outer face, and a copy surface being substantially uninterrupted, substantially flat, adhered to the plurality of outer faces, and displaying a composite image comprising a plurality of sub-parts, and the bracket assembly of claim 1, the steps of the method comprising:

a. selecting a size of the louvers to fit a predetermined composite image location;

b. selecting a template corresponding in size to the selected size of the louvers, the template for temporarily securing the louvers having said bracket assembly;

c. securing the louvers within the template by the bracket assembly at least;

d. calculating the dimensions of the copy surface based on the predetermined composite image location and the selected size of the louvers;

e. calculating the magnitude of a transition loss, the transition loss being the portion of the composite image in an unprintable region between the louvers;

f. cleaning the copy surface with an evaporative solution;

g. determining the sub-parts of the composite image based on the dimensions of the copy surface, the width of the louvers, and the magnitude of the transition loss;

h. selectively adhering determined sub-parts of the composite image to the copy surface; and i. selectively cutting the adhered sub-parts of the composite image to fit the copy surface such that corresponding ones of the plurality of outer faces each display a sub-part of the composite image, respectively.

7. The method according to claim, 6 wherein the transition loss is no less than one-thirty-secondth of an inch and no more than one eighth of an inch.

8. The method according to claim 7, wherein the transition loss is one thirty-second of an inch when the louvers are one inch wide, one-eighth of an inch when the louvers are three and a half inches wide, and linearly correlated between one thirty-second of an inch and one eighth of an inch for louvers between one inch and three and a half inches in width.

9. The method according to claim 6, further comprising the step of adhering the determined sub-parts of a composite image taken from a group consisting of electrostatic graphics, ink-jet graphics, silk screening, and thermal transfer vinyl graphics.

10. The method according to claim 6, further comprising the step of adhering the determined sub-parts of a composite image, wherein the composite image is an electronically generated image.

11. The method according to claim 6, further comprising the step of smoothing the adhered sub-parts of the composite image to reduce air pockets therebetween.

* * * * *